United States Patent [19]

Crover et al.

[11] 3,971,448

[45] July 27, 1976

[54] BREAKER CONSTRUCTION AND VALVE THEREFOR

[75] Inventors: Stephen Earl Crover, Boring; Gordon Eugene Brown, Milwaukee, both of Oreg.

[73] Assignee: The Stanley Works, New Britain, Conn.

[22] Filed: Feb. 18, 1975

[21] Appl. No.: 550,661

Related U.S. Application Data

[63] Continuation of Ser. No. 394,518, Sept. 4, 1973, abandoned.

[52] U.S. Cl. ..... 173/134; 91/235; 91/300

[51] Int. Cl.[2] ..... B25D 9/20; B25D 9/04

[58] Field of Search ..... 173/134, 135; 91/235, 91/291, 297, 298, 300, 301

[56] References Cited

UNITED STATES PATENTS

| | | | |
|---|---|---|---|
| 2,951,468 | 9/1960 | Hecke | 91/335 |
| 3,232,176 | 2/1966 | Henning et al. | 91/300 |
| 3,399,602 | 9/1968 | Klessig | 91/235 |
| 3,411,592 | 11/1968 | Montabert | 91/301 X |
| 3,739,863 | 6/1973 | Wohlwend | 91/321 X |

*Primary Examiner*—John E. Murtagh
*Assistant Examiner*—William F. Pate, III

[57] ABSTRACT

A fluid operated tool is provided which is operable particularly for purposes of causing the linear movement of a tool member in at least one direction. The tool includes a main body, a trigger, an On-Off valve spool, a main piston, a reversing assembly, an accumulator and means for attaching the tool member to the tool. The main body is provided with a plurality of bores in which the On-Off valve spool, the main piston, the reversing assembly, and the accumulator are respectively positioned, and a plurality of channels which function to interconnect the bores. The On-Off valve spool is supported in one of the bores in such a manner as to be operatively connected to the trigger whereby the valve spool moves between first and second positions in response to the actuation of the trigger thereby to selectively open and close various ones of the channels formed in the main body. The main piston is supported in a longitudinally extending bore whereby to be reciprocal therein between a first position wherein the main piston drives the tool member toward one end of the tool, the tool member being attached to the main body through the operation of means provided for this purpose, and a second position wherein the piston is spaced from the aforementioned one end of the tool. The main piston is shiftable between its first and second positions by fluid pressure applied alternately to selective faces thereof in accordance with predetermined fluid flow paths which are established in the channels by virtue of the respective positions which the reversing assembly and the valve spool alternately occupy. The accumulator which is positioned in another bore of the main body whereby to be movable therein functions as a source of stored energy.

10 Claims, 13 Drawing Figures

"OFF"

"ON"

BREAKER CONSTRUCTION AND VALVE THEREFOR

CROSS REFERENCE TO RELATED APPLICATION

The present application is a continuation of Application Ser. No. 394,518, filed Sept. 4, 1973 entitled *BREAKER CONSTRUCTION AND VALVE THEREFOR*, now abandoned.

BACKGROUND OF THE INVENTION

It has been known heretofore in the prior art to utilize any one of three different types of power tool systems, i.e., hydraulic, pneumatic, and electric. In comparing the relative advantages of the three types of systems, it has been found however, that a hydraulically operated system possesses several advantages relative to the other two. For example, because hydraulically operated tools are powered by oil, they are self-lubricating. Therefore, they do not require the expensive air dryers which are commonly required for example, in air systems to prevent corrosion. Also, hydraulically operated systems won't freeze up in cold weather, thereby saving time which otherwise would be required to unfreeze the system as well as assisting to keep maintenance costs at a minimum.

Another desirable characteristic of hydraulic power tool systems is that they are relatively lightweight. This means therefore, that they are much easier to handle on the job and for much longer periods of time. In addition, they are much more easily moved from one job to the next. With regard further to the matter of mobility, hydraulic power tools do not require bulky expensive compressors. In fact, such tools may be used virtually anywhere. They can operate off a truck, tractor, backhoe or any other available hydraulic source. On the other hand, if extra power is required for multi-tool operations, they are also capable of being used with one of the portable hydraulic units which are presently commercially available.

A further desirable characteristic of hydraulic power tools is that they are inherently relatively quiet. As a result, no costly noise reduction alterations, which commonly are required in other systems, are needed. Noise level ordinances now being passed in cities across the country make built-in quietness an even more attractive feature for a power tool system to possess.

To thus summarize, a hydraulic power tool system enjoys the following advantageous characteristics. It is characterized by having high power-to-weight performance. It provides low cost operation and maintenance. In addition, it is quiet in operation and is capable of being easily handled by virtue of its light weight.

Notwithstanding the fact that the hydraulic power tool systems which have typically been available in the prior art heretofore have embodied the characteristics which have been discussed herein above, there has nevertheless existed the need to provide such a power tool system which would be simpler in construction. There are numerous reasons why it is desirable to be able to provide a hydraulic power tool system which has a construction that is simpler than those previously known. For example, simplifying the construction provides economy of manufacture by virtue of the fact that fewer parts need to be produced and also economy of assembly since less time and effort is required to assemble the components which comprise the system. In addition, by simplifying the construction a further reduction is capable of being effected in the weight of the hydraulic power tool system thereby further improving the power-to-weight performance of the system. Finally, the maintenance requirements with a simpler construction are obviously less than those which are to be expected with a more complex structure just by virtue of the increased number of parts in the latter structure which need attention from a maintenance standpoint apart from any other consideration which may be applicable in this regard.

Accordingly, it is an object of the present invention to provide a novel and improved hydraulic power tool and more particularly, a fluid operated breaker which possesses a high power-to-weight ratio thereby providing increased efficiency and also lessening operator fatigue.

It is also an object of the present invention to provide such a hydraulic power tool which embodies a stepped, pilot operated valve which allows small pilot areas to control large flows in a simple and compact manner.

A further object of the present invention is to provide such a hydraulic power tool which embodies an accumulator system which is operable to store energy for subsequent release under preselected conditions, at a predetermined time interval, etc. and which includes vent means operable for venting any leakage of fluid or gas to prevent contamination of one with the other.

A still further object of the present invention is to provide such a fluid operated breaker which is capable of being employed to drive tools of the type presently known in the prior art.

Yet another object of the present invention is to provide such a fluid operated breaker which has a simplified construction that enables economies of manufacture and assembly to be effected.

SUMMARY OF THE INVENTION

It has now been found that the foregoing and related objects can be readily attained in a fluid operated tool which is operable particularly for purposes of causing the linear movement of a tool member in at least one direction. The fluid operated tool includes a body that is provided with a pair of spaced, longitudinally extending bores, another smaller bore, and a transversely extended bore which is located between the pair of longitudinally extended bores and the smaller bore. A plurality of channels are formed in the body which function to interconnect the aforementioned bores thereby to establish fluid flow paths therebetween. The tool further includes an externally accessible trigger, an On-Off valve spool which is operatively connected to the trigger, a main piston, a reversing assembly and an accumulator. The valve spool is supported in one of the pair of longitudinally extending bores whereby to be movable therewithin. Movement of the valve spool is controlled through operation of the trigger. The main piston which is positioned in the other of the pair of longitudinally extending bores reciprocates therein between first and second positions. More particularly, the main piston is driven in a power stroke between a first position wherein the piston is spaced from the tool member to a second position wherein the piston does work in driving the tool member in the aforereferenced first direction and is driven in a return stroke from the second position thereof to its first position. With the trigger activated whereby the valve spool is moved to a position corresponding to the On condition thereof, fluid flow paths are established whereby fluid forces are applied to the main piston to cause the latter to be alternately driven in its power stroke and its return stroke. In addition, fluid flow paths are established whereby fluid forces are applied to the reversing assembly which is positioned in the transversely extending bore whereby to cause the reversing assembly to move therein and to control by virtue of its movement the reversal of the direction of movement of the main piston. The accumulator is positioned in the smaller bore whereby it is capable of movement therein and functions as a source of stored energy.

In accordance with the preferred embodiment of the invention, the fluid operated tool comprises a breaker which is operable particularly for purposes of imparting repetitive blows to a tool bit operatively connected thereto whereby to drive the tool bit against a surface such as concrete, asphalt, rock, etc., so as to effect a fast, easy breaking of the surface. The breaker includes a body having an inlet port and an outlet port. The inlet and outlet ports communicate with the bore in which the valve spool is operated whereby when the trigger is in its rest position a fluid flow path is established in the breaker whereby hydraulic fluid supplied to the inlet port flows therethrough, around the valve spool, and out the outlet port. In this connection, all of the channels are subject to the same fluid pressure which is commonly known as the circulation pressure. By virtue of the fact that one end of the piston is at atmospheric pressure while the other end is subject to the circulation pressure, the piston moves to a position wherein it engages the tool thereby establishing a condition which is referred to as the breaker "stretching". Upon actuation of the trigger, the valve spool moves to a second position thereof which effects a closing of the direct flow path between the inlet and outlet ports around the valve spool. The piston is provided with a plurality of lands which provide the former with a plurality of areas having definite cross sections. As a result, with the trigger in the actuated condition, a fluid flow path is established in the breaker whereby fluid acts on one of the lands of the piston causing the latter to move away from the tool in the upstroke of the piston. At the same time fluid pressure is acting on the reversing assembly and more particularly on the ends of the reversing valve spool thereof. Since the ends of the reversing valve spool are of unequal cross sectional areas, a resulting force is present, by virtue of the fluid pressure, which tends to move the reversing valve spool to a first position. As the piston continues to move away from the tool, fluid is exhausted from the path of movement thereof through a restriction which is effective to retard the return stroke of the piston and thereby allowing excess input energy in the form of pressure and flow to be diverted to the accumulator. This energy causes the accumulator piston to move against a compressible gas providing stored energy. Upon reaching a position corresponding to the end of the return stroke of the piston, a fluid flow path is established whereby a high pressure is applied to a step up force area which is formed in one of the reversing valve spool. The fluid pressure acting on this step up force area functions to pull the reversing valve spool to a second position thereof which is in contrast to the conventional mode of operation wherein the reversing valve spool is pushed to the latter position. With the reversing valve spool occupying the latter position high pressure fluid is applied to the end of the piston. In addition, the accumulator is also able to release its stored energy by pushing the fluid, which is in the accumulator, out of the latter into a suitable channel whereby a fluid flow path is established which is operable to cause the fluid from the accumulator to combine with the previously described high pressure fluid thereby to impart a high degree of kinetic energy to the piston. Work in the form of a blow being applied to the tool is done when the piston reaches a position corresponding to the end of the power stroke thereof. The above described cycle of operation is then repeated whereby to cause another blow to be imparted to the tool by the piston.

DETAILED DESCRIPTION OF THE ILLUSTRATED EMBODIMENT

Figure 1:
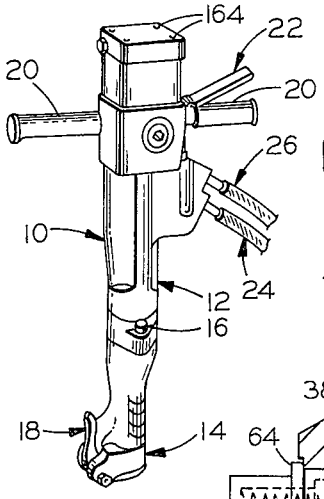
FIG. 1 is a perspective view of a fluid operated breaker constructed in accordance with the present invention.

Referring now to the drawings and more particularly FIG. 1 thereof, there is illustrated therein a fluid operated breaker, generally designated by reference numeral 10, constructed in accordance with the present invention and particularly adapted to be employed for purposes of driving a tool bit operatively connected thereto into engagement with a surface such as concrete, asphalt, rock, etc., whereby to achieve a fast, easy breaking of the latter surface. The fluid operated breaker 10 as illustrated in FIG. 1 includes the main breaker body 12 which has a foot assembly 14 fastened thereto at one end thereof by any suitable means such as, for example, through the use of a pair of threaded fasteners 16, only one of which is visible in FIG. 1 of the drawings, which are received in suitable openings provided for this purpose in the body 12 and foot assembly 14. The foot assembly 14 is capable through the latch means 18 provided thereon of operatively connecting a tool bit, not shown in FIG. 1 of the drawings, to the breaker 10. Inasmuch as the construction and mode of operation of the latch means 18 is well known to those skilled in the art, it has not been deemed necessary for an understanding of the present invention to describe and illustrate herein the details of construction of the latch means 18. At the other end of the breaker body 12, a pair of handle grips 20 are supported whereby to extend outwardly from a pair of opposed sides of the body 12 substantially at right angles thereto. Adjacent to one of the handle grips 20, a trigger assembly 22 is supported in a manner yet to be described and for a purpose which will be set forth subsequently. Furthermore, there are provided a pair of hose assemblies 24 and 26 which function as inlet means and outlet means, respectively, for the hydraulic fluid which powers the breaker 10. The hose assemblies 24 and 26 are fastened to the breaker body 12 in a manner which will be referred to in more detail hereinafter.

Figure 2:
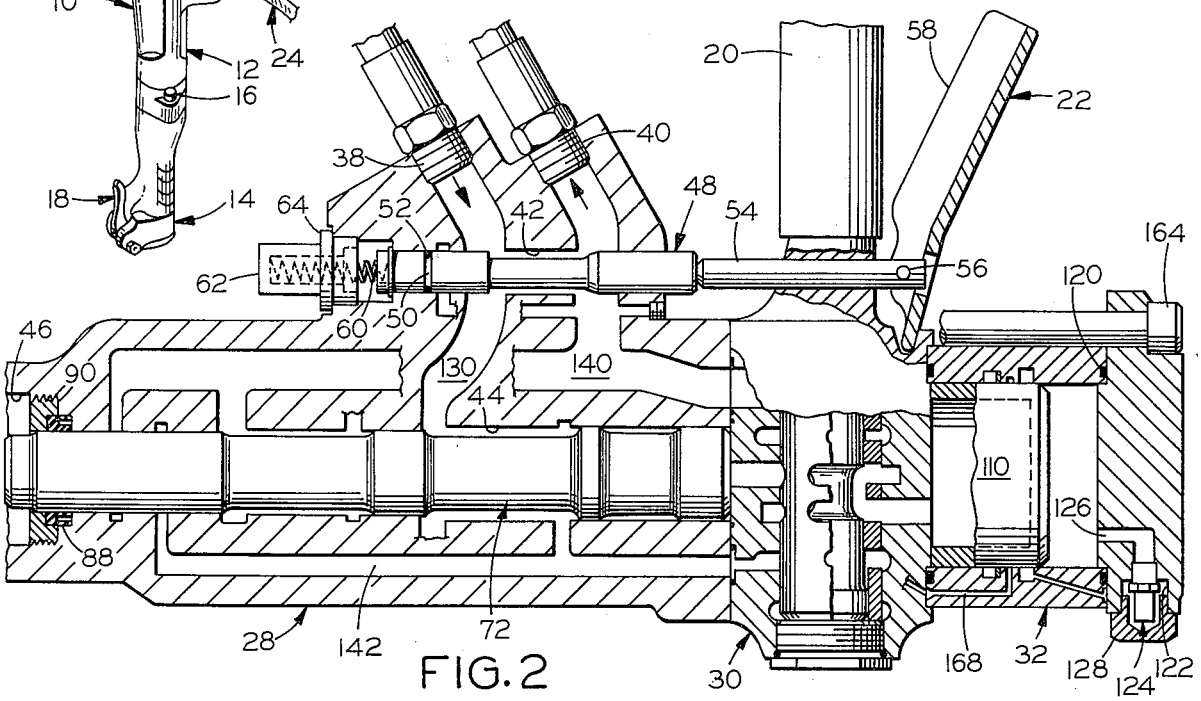
FIG. 2 is a cross-sectional view with some parts broken away for purposes of clarity of illustration of a portion of a fluid operated breaker constructed in accordance with the present invention, illustrating the relationship of the parts thereof with the trigger in the rest position.
Figure 3:
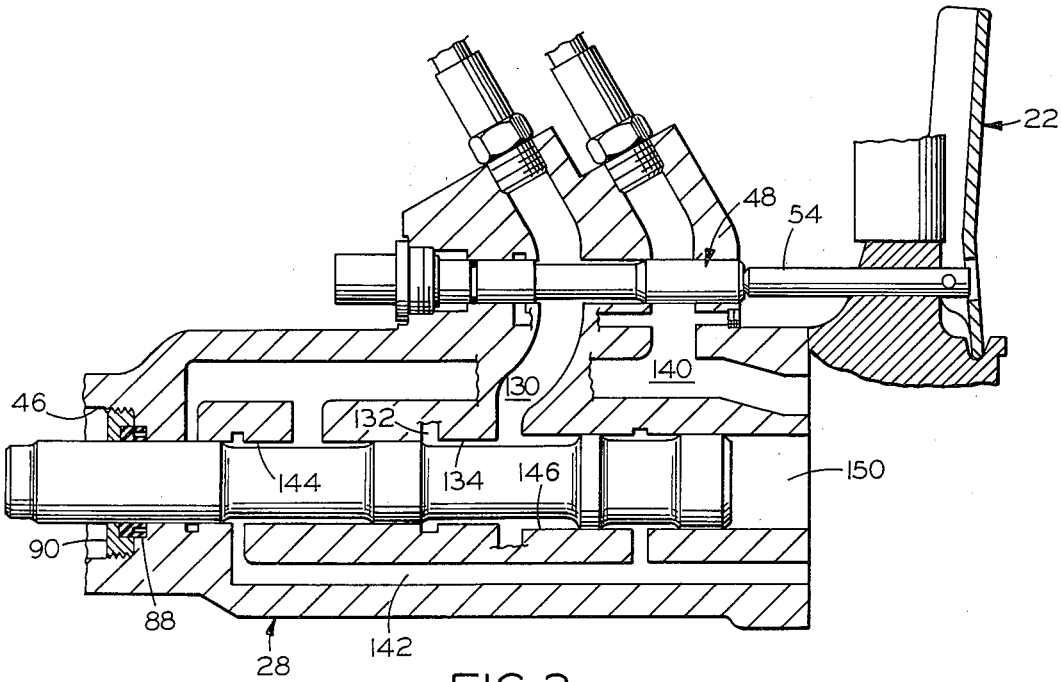
FIG. 3 is a cross-sectional view with some parts broken away for purposes of clarity of illustration of a portion of a fluid operated breaker constructed in accordance with the present invention, illustrating the relationship of the parts thereof with the trigger actuated.
Figure 4:
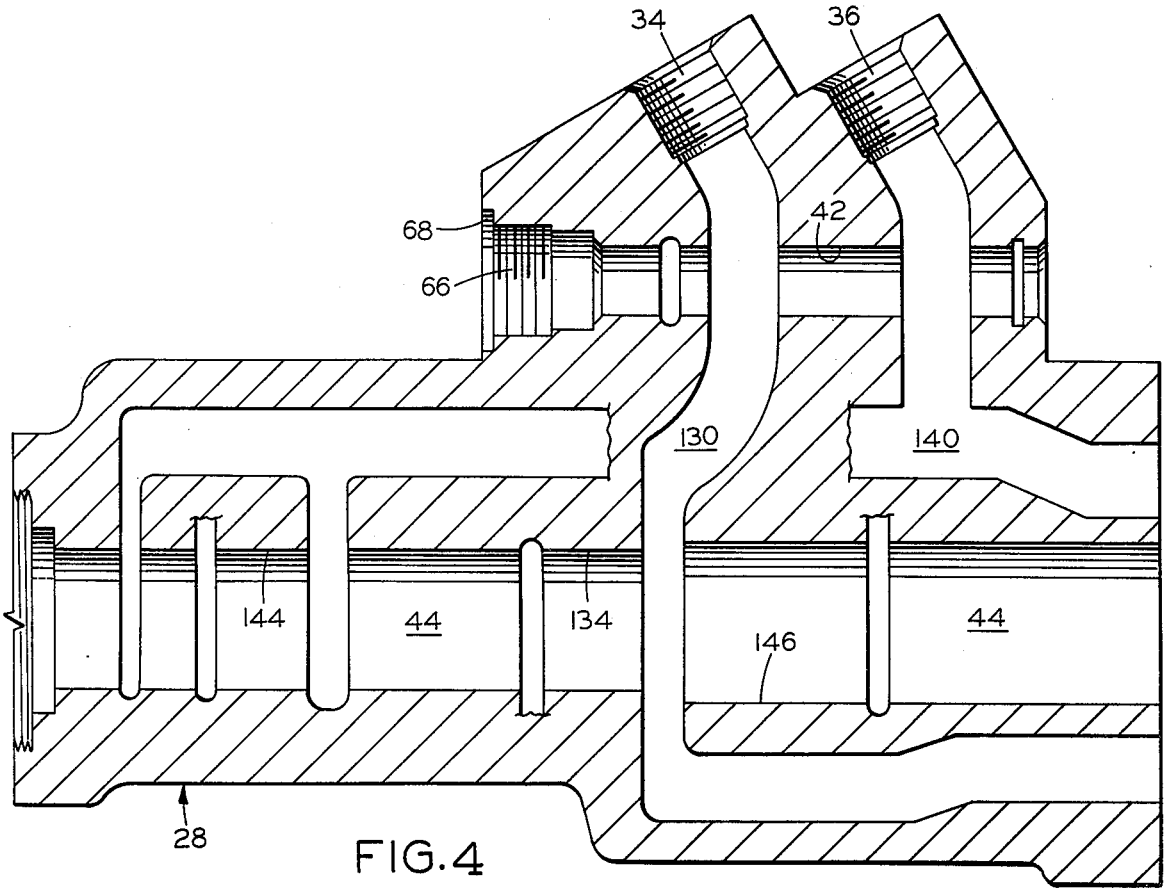
FIG. 4 is a cross-sectional view on an enlarged scale with some parts omitted for purposes of clarity of illustration of a portion of a fluid operated breaker constructed in accordance with the present invention, illustrating the inlet and outlet ports and the channels communicating therewith.

Turning now to a consideration of FIGS. 2, 3 and 4 of the drawings, it can be seen with particular reference to FIG. 2 that the breaker body 12 is comprised essentially of three sections. These three sections include a main body section 28, a reversing assembly section 30 from which the handle grips 20 project and on which the trigger assembly 22 is supported, and an accumulator section 32. With regard more particularly to the details of construction of the main body section 28, the latter has formed therein an inlet port 34 and an outlet port 36. Each of the ports 34 and 36 is threaded for purposes of receiving a conventional fitting 38 and 40, respectively, in threaded engagement therewithin. The fittings 38 and 40 function to connect the inlet hose assembly 24 to the inlet port 34 and the outlet hose assembly 26 to the outlet port 36, respectively. In addition, the main body section 28 includes a pair of longitudinally extending bores 42 and 44, the latter bore 44 at one end thereof connecting with the opening 46 provided in the left end of the body breaker 12 as viewed with reference to FIG. 2 of the drawings. The opening 46 provides a means whereby the end of a conventional tool bit (not shown) can be inserted therein and then latched in place through operation of the latch means 18 thereby to operably connect the tool bit to the breaker 10 as will be referred to more fully subsequently. Finally, a plurality of channels, to which specific reference will be had hereinafter in connection with the description of the mode of operation of the breaker 10, are formed in the main body section 28 whereby these channels serve to fluidically connect the inlet port 34, the outlet port 36 and the bores 42 and 44.

With further reference to FIGS. 2, 3 and 4 of the drawings, the bore 42 is suitably dimensioned whereby to be capable of receiving an On-Off valve spool 48 in sliding movement therewithin. In accordance with the illustrated embodiment thereof, the valve spool 48 includes a pair of lands **48*a* and 48*b* between which exists a groove 48*c*. The lands 48*a* and 48*b* as well as the groove 48*c* each are formed so as to have a particular length which has been selected whereby to enable the valve spool 48 to function in accordance with a predetermined mode of operation, a description of which will be found set forth hereinafter. In addition, the valve spool 48 has a circumferential notch 50 formed in the land 48*a* thereof which is operable for purposes of receiving an O-ring gasket 52 therein whereby to establish a fluid tight seal between the valve spool 48 and the side walls of the bore 42**.

The right end of the On-Off valve spool 48, as viewed with reference to FIG. 2 of the drawings, is operatively connected to one end of a trigger push pin 54 by virtue of being spring biased into engagement therewith in a manner yet to be described whereby sliding movement can be imparted to the valve spool 48 as a result of a pushing force being applied to the right end of valve spool 48 by the pin 54. The trigger push pin 54 which comprises one of the components of trigger assembly 22 is pinned at its other end by roll pin 56 to the trigger 58. Trigger 58 is suitably mounted on the reversing assembly section 30 whereby the trigger 58 is capable of pivoting relative thereto between a first, i.e., rest position and a second, i.e., actuated position.

As best understood with reference to FIG. 2 of the drawings, a spring biasing force is applied to the other, i.e., left end of the On-Off valve spool 48. This spring biasing force is operable to bias the valve spool 48 to the right, i.e., to the position illustrated in FIG. 2 which comprises the Off position of valve spool 48, the latter position corresponding to the condition wherein the trigger 58 is not actuated. The spring biasing force is produced by a spring 60, one end of which bears against a seat formed for this purpose at the other, i.e., the left end of valve spool 48, as viewed with reference to FIG. 2 of the drawings. The other end of the spring 60 is captured in the hollow interior of spring cap 62 whereby the other end of the spring 60 bears against a seat provided for this purpose therein. The spring cap 62 in accord with the embodiment thereof illustrated in the drawings is provided with threads so that the spring cap 62 is capable of being received in the left end of the bore 42 in the manner depicted in FIG. 2 of the drawings. For this purpose, the left end of the bore 42 as shown in FIG. 4 is also provided with threads 66 such that the spring cap 62 is capable of being threadedly engaged therewith. The spring cap 62 furthermore is preferably provided with a circumferential flange 64 which is formed integrally therewith. The flange 64 is located on the spring cap 62 so as to be suitably spaced from the opposite ends of the latter whereby when the spring cap 62 is threadedly engaged in the left end of the bore 42 in the manner illustrated in FIG. 2 of the drawings, the flange 64 abuts against the external surface of the main body section 28 which surrounds the open left end of bore 42. For this purpose, a countersunk depression 68 is provided in the external surface of the main body section 28. It will also be noted with reference to FIG. 2 of the drawings that the valve spool 48 is preferably provided with a snap ring 70 which is mounted thereon adjacent the left end thereof. The snap ring 70 functions as a form of stop means to limit the extent of sliding movement which the valve spool 48 is capable of undergoing.

Figure 5:
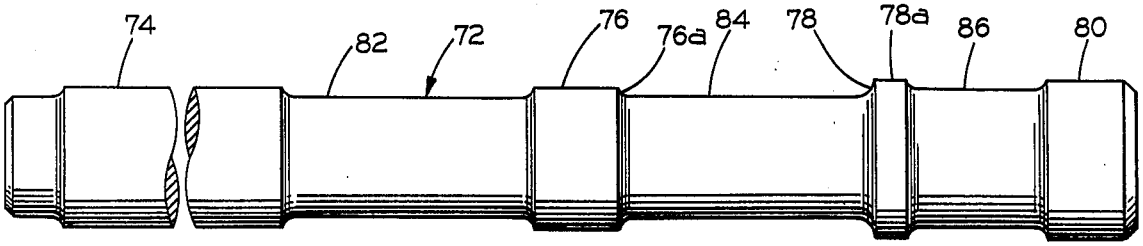
FIG. 5 is a side elevational view on an enlarged scale of the main piston of a fluid operated breaker constructed in accordance with the present invention.
Figure 6:
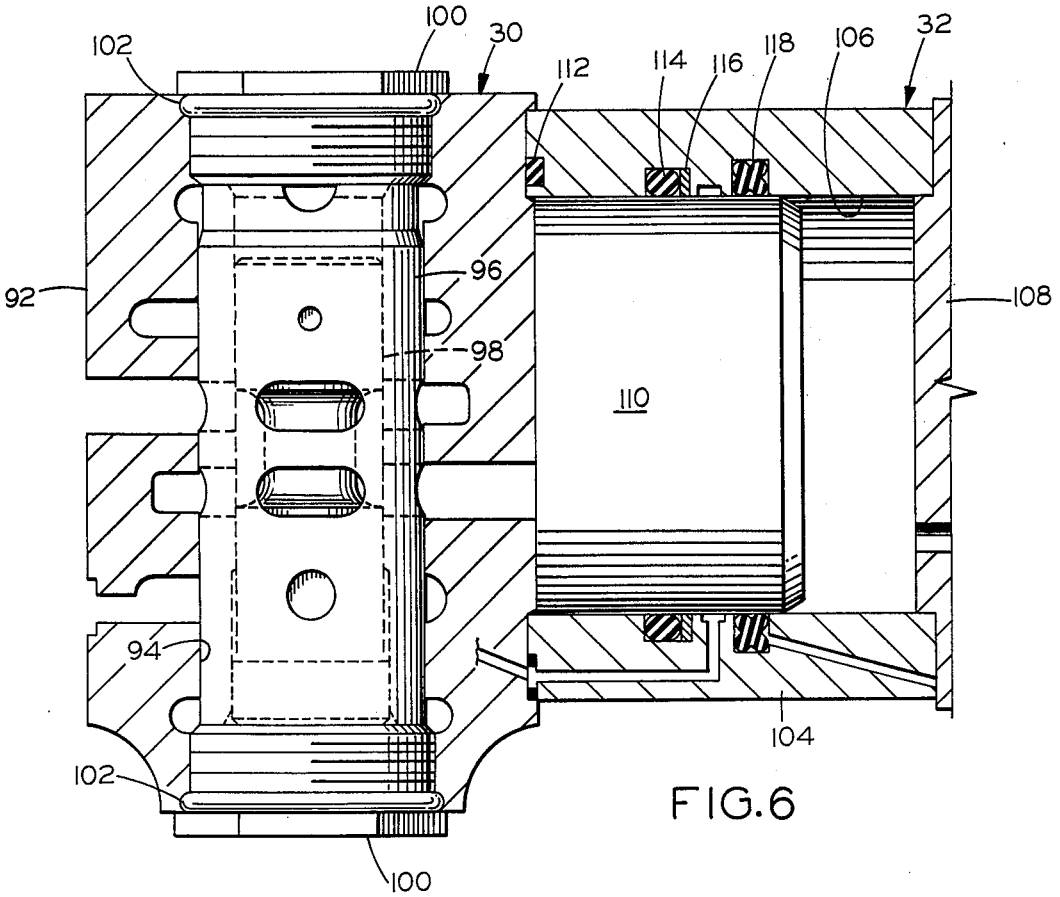
FIG. 6 is a cross-sectional view on an enlarged scale on the reversing assembly and accumulator portion of a fluid operated breaker constructed in accordance with the present invention.

Referring now to FIGS. 2, 3 and 5 of the drawings, the other longitudinally extending bore formed in the main body section 28, i.e., bore 44 is suitably dimensioned whereby to be capable of receiving the main piston 72 for sliding movement therewithin. As best seen in FIG. 5 of the drawings, the piston 72 includes four lands 74, 76, 78 and 80 between which there exists the grooves 82, 84 and 86, respectively. The lands 74, 76, 78 and 80 as well as the grooves 82, 84 and 86 are each made so as to have a particular length which has been selected whereby to enable the piston 72 to function in accordance with a predetermined mode of operation, a description of which will be found set forth hereinafter. The left end of the piston 72 as viewed with reference to FIG. 2 of the drawings passes through a seal 88, the latter being operable to provide a fluid tight seal between the piston 72 and side walls of the bore 44. The seal 88 is retained in place in accord with the illustrated embodiment of the invention by a lower closure nut 90 which is provided with threads which enable the nut 90 to be threadedly engaged with a threaded portion of the main body section 28 which is provided for this purpose surrounding the open left end of the bore 44.

Turning now to a consideration of the reversing assembly section 30, as best understood with reference to FIGS. 2 and 6–9 of the drawings, the reversing assembly section 30 includes a body portion 92 having a bore 94 formed therein in which there is received a reversing valve sleeve 96. A reversing valve spool 98 is supported in the sleeve 96 for sliding movement therewithin. The handle grips 20 which were referred to previously hereinabove are preferably formed integrally with the body portion 92 whereby to extend outwardly from a pair of opposite sides thereof substantially at right angles thereto. The bore 94 is formed in body portion 92 so as to extend transversely of the major axis of the breaker 10. As seen with reference to FIG. 7 of the drawings, a plurality of channels, to which specific reference will be had hereinafter in connection with the description of the mode of operation of the breaker 10, are formed in the body portion 92 whereby to provide fluid flow connections between the bore 94 and the inlet port 34, the outlet port 36 and the bores 42 and 44. The reversing valve sleeve 96 as well as the reversing valve spool 98 each have passages formed therein as will be described more fully subsequently which communicate with the aforedescribed channels. In addition, the reversing valve sleeve 96 and the reversing valve spool 98 are each provided with a hollow interior whereby in the case of the sleeve 96 to enable the valve spool 98 to slide therewithin and in the case of the valve spool 98 to enable hydraulic fluid to flow therethrough for a purpose yet to be described. Finally, as best seen with reference to FIG. 6 of the drawings, each end of the bore 94 is preferably closed by means of a threaded plug 100 which is threadedly engaged with threads provided for this purpose in each end of the bore 94. The plugs 100 also function to keep the reversing valve sleeve 96 properly positioned therebetween. Preferably a suitable gasket 102 is employed in association with each of the plugs 100 to prevent leakage of hydraulic fluid out of the bore 94 around the plugs 100.

The remaining section of the breaker body 12 which has yet to be described comprises the accumulator section 32. The latter section 32 includes a body portion 104 in which a through bore 106 is formed. One end of the bore 106 is closed by the accumulator head 108 which also comprises the top of the breaker 10. The other end of the bore 106 is closed except for suitable channels which communicate therewith by an end wall of the body portion 92 of reversing assembly section 30. An accumulator piston 110 is supported within the bore 106 for sliding movement therewithin. In order to prevent leakage between the accumulator section 32 and the reversing assembly section 30, between the body portion 104 and the accumulator head 108, a plurality of gaskets are suitably supported therebetween. Thus, for example, an O-ring gasket 112 is interposed between the accumulator section 32 and the reversing assembly section 30 in a groove provided for this purpose in the body portion 104. Between the accumulator piston 110 and the side walls of bore 106, in accord with the illustrated embodiment of the invention, an O-ring gasket 114 and a backup ring 116 are interposed in a groove formed for this purpose in the side walls of the bore 106 around the circumference thereof intermediate the ends of the bore 106. In addition, a quad ring gasket 118 is also preferably employed between the accumulator piston 110 and the side walls of the bore 106. The gasket 118 is positioned in a circumferential groove formed in the side walls of the bore 106 in slightly spaced relation to the groove in which the gasket 114 and ring 116 are supported. A seal is established between the accumulator head 108 and the body portion 104 preferably by means of an O-ring gasket 120 which is interposed therebetween in a groove provided for this purpose in the end wall of body portion 104. The accumulator head 108 has an opening 122 formed in a side wall thereof in which a charging valve 124 is mounted. The charging valve 124 is preferably retained in position by virtue of a threaded engagement between threads provided for this purpose on one end of the charging valve 124 and the threads with which the opening 122 is provided. The charging valve 124 is operable to permit a compressed gas to be supplied therethrough to the area of the bore 106 which lies behind the accumulator piston 110 for a purpose yet to be described. More particularly, a suitable compressed gas is capable of being fed through opening 122 and the channel 126, which is formed in the accumulator head 108 so as to have one end in communication with the opening 122 and one end in communication with the bore 106, to the bore 106. A charging valve cap 128 is employed for purposes of closing the opening 122. To this end, as shown in FIG. 2 of the drawings, the cap 128 is threadedly engaged with the threaded portion provided for this purpose in the surface of the side wall of the accumulator head 108 surrounding the opening 122.

Turning now to a description of the mode of operation of the breaker 10, reference will be had hereinafter to FIGS. 2, 3 and 10-12 for an understanding of the relative positions which the components of the breaker 10 occupy at different periods during the cycle of operation of the breaker 10. When the trigger 58 is not actuated, the On-Off valve spool 48 is positioned as illustrated in FIGS. 2 and 3 of the drawings which corresponds to the Off condition thereof. At the beginning of the cycle of operation with the On-Off valve spool 48 in the Off position, the main piston 72 occupies the position illustrated in FIG. 3. All of the channels which fluidically interconnect the inlet port 34, the outlet port 36, the bores 42, 44 and 94 are all subjected to the same fluid pressure, which is commonly termed the circulation pressure. As a result, the piston 72 is caused to move to its left most position, i.e., the position shown in FIG. 3, since the left end of the piston 72 is at atmospheric pressure and the right end of the piston 72 as viewed therein is being subjected to a higher pressure, i.e., the circulation pressure.

Figure 13:
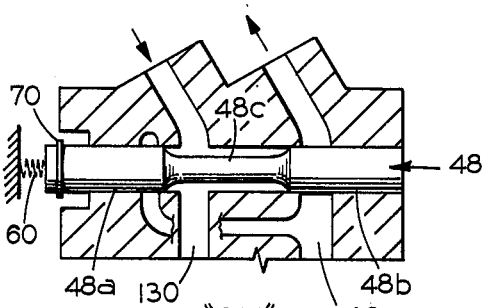
FIG. 13 is a schematic operating diagram of the On-Off valve spool of a fluid operated breaker constructed in accordance with the present invention, illustrating the On-Off valve spool in its On condition which corresponds to the actuated position of the trigger.

Upon the trigger 58 being actuated so as to cause the push pin 54 to move the On-Off valve spool 48 to its On position, i.e., the position thereof depicted in FIGS. 3 and 13 of the drawings, channel 130 becomes subjected to high pressure fluid fed thereto through inlet port 34. Channel 132 which as depicted in FIG. 3 is in communication with channel 130 through the portion of the bore 44 identified therein by reference numeral 134 becomes subject to this pressure fluid as well. As best understood with reference to FIG. 10 of the drawings, this fluid pressure which is established in channel 132 then acts on the end 136 of reversing valve spool 98. In addition, since the valve spool 98 has a hollow interior fluid flows therethrough and therefore fluid pressure is also applied to the other end, i.e., end 138 of valve spool 98. Since the cross sectional area of the end 138 of the valve spool 98 is greater than the cross sectional area of the end 136 thereof, a resultant force is produced, by virtue of the fluid pressure, which tends to move the reversing valve spool 98 to the position shown in FIG. 10 of the drawings.

Channel 140 at this time is subjected to a low fluid pressure. Channel 142 also is subject to the low pressure fluid by virtue of its connection with channel 140 through the portion of the bore 44 identified in FIG. 3 by the reference numeral 144. This low pressure fluid then acts on the step up area, i.e., the flange portion 148 of the reversing valve spool 98, through channel 144. The force area comprised by the flange portion 148 is equal and opposite to the resultant force area comprised by the difference in force areas of the ends 136 and 138 of the reversing valve spool 98, i.e., the force area 138 minus the force area 136.

Figure 10:
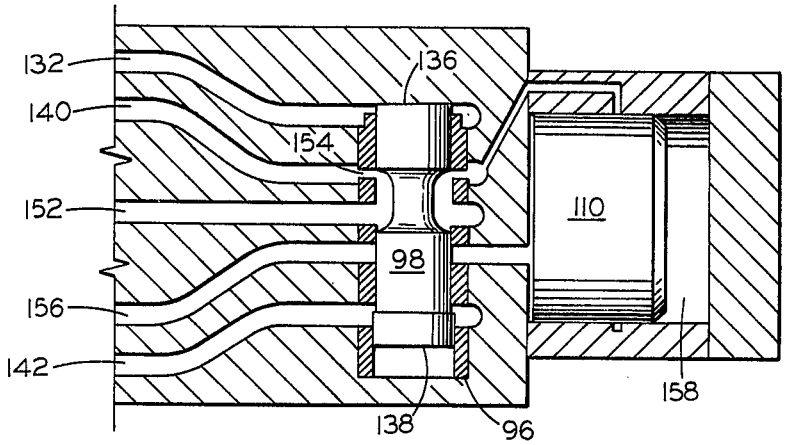
FIG. 10 is a schematic operating diagram illustrating the position of the reversing valve spool of the reversing assembly of a fluid operated breaker constructed in accordance with the present invention when the main piston of the breaker is at the end of its power stroke.
Figure 11:
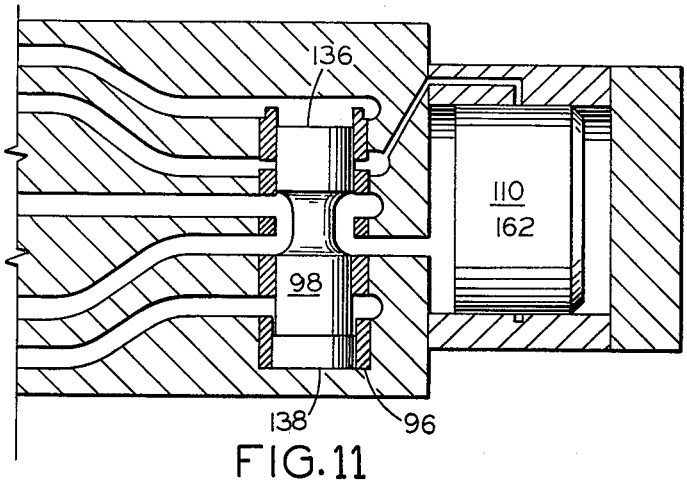
FIG. 11 is a schematic operating diagram illustrating the position of the reversing valve spool of the reversing assembly of a fluid operated breaker constructed in accordance with the present invention when the main piston of the breaker is at the end of its return stroke.

With the reversing valve spool 98 and the piston 72 positioned as shown in FIGS. 10 and 3, respectively, pressure fluid acts against the areas **76*a* and the area 78*a*, identified in FIG. 5 of the drawings, of the piston 72 through the portion of the bore 44 identified in FIG. 3 by reference numeral 146. Area 78*a*, being larger than area 76*a*, causes the piston 72 to move to the right as viewed with reference to FIG. 3 of the drawings, i.e., towards the reversing valve spool 98. The fluid in the portion of the bore 44 behind the piston 72, i.e., in the volume designated by reference numeral 150 in FIG. 3 is forced through channel 152 and through a restriction 154 to the low pressure channel 140. The restriction 154 causes the return stroke of the piston 72 to be retarded, allowing excess input energy in the form of pressure and flow to be diverted through channel 156 to the bore 106 of the accumulator assembly 32. This energy causes the accumulator piston 110 to move against a suitable compressible gas which fills the volume of bore 106 behind the accumulator piston 110, i.e., the volume designated by the reference numeral 158 in FIG. 10,** thereby providing stored energy.

When the piston 72 reaches the piston thereof illustrated in FIG. 2 of the drawings, the step up area 148 of reversing valve spool 98 is subject to the high pressure fluid by virtue of the fluid path which is established through channel 142 to channel 130 through the portion of the bore 44 identified by the reference numeral 146. This high pressure creates a force tending to move the reversing valve spool 98 to the position depicted in FIG. 11 of the drawings. The opposite ends 136 and 138 of the valve spool 98 are subject to low pressure through the fluid path established through channel 132 to channel 140 through the portion of the bore 44 identified by reference numeral 144. With the reversing valve spool 98 occupying the position illustrated in FIG. 10 of the drawings, the high pressure fluid is able to act on the right end of piston 72 as viewed with reference to FIG. 2 through channels 130 and 152. The accumulator assembly 32 is also operable to release the energy stored therein by virtue of the accumulator piston 110 pushing the fluid out of the portion of the bore 106 which is identified in FIG. 11 by reference numeral 166 and through channel 162 and channel 152. In this connection, as illustrated in FIG. 2 of the drawings, the accumulator piston 110 is substantially U-shape in configuration, i.e., it has a substantially hollow interior. This fluid from the accumulator assembly 32 combines with the high pressure fluid described above to impart high kinetic energy to the piston 72. Work is done when the piston 72 reaches the position illustrated in FIG. 3 of the drawings wherein the piston 72 strikes a suitable tool (not shown). The latter tool is cooperatively associated with the breaker 10 through the operation of the latch means 18 whereby one end of the tool is suitably received in the opening 46 so as to be struck by the left end of the piston 72, as the latter reaches the position depicted in FIG. 3.

Figure 12:
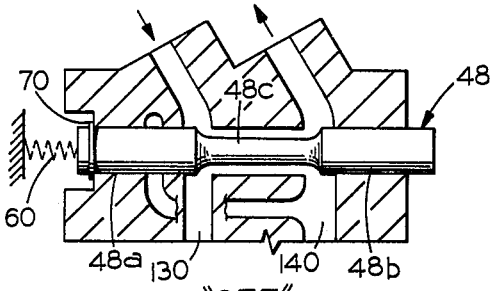
FIG. 12 is a schematic operating diagram of the On-Off valve spool of a fluid operated breaker constructed in accordance with the present invention, illustrating the On-Off valve spool in its Off condition which correspoonds to the rest position of the trigger.

Thus, to briefly summarize the mode of operation of the breaker 10, when the trigger 58 is at rest, hydraulic fluid, i.e., oil circulates from inlet port 34 to outlet port 36 past the On-Off valve spool 48 as schematically depicted in FIG. 12 of the drawings. Circulating pressure causes movement of the piston 72 to the left as viewed with reference to FIG. 2 of the drawings, i.e., the breaker "stretches". Actuation of trigger 58 closes the escape path for the oil from the inlet port 34 to the outlet port 36 in the manner shown in FIG. 13 of the drawings. Pressure fluid then acts on area **78*a* of the piston 72. The effective force area is such that the piston 72 is caused to move to the right as viewed in FIG. 3 of the drawings, i.e., the piston 72 is caused to move in its upstroke. Pressure fluid is also acting in channel 132 causing upward movement of the reversing valve spool 98, as viewed with reference to FIG. 2 of the drawings. This allows oil in the portion of the bore 44 identified by reference numeral 150 to go to exhaust. As piston 72 continues moving to the right, a flow path is established from inlet portion 34 through channel 130 to channel 142. As a result, channel 142** receives pressure fluid and channel 132 goes to exhaust producing a downward shift, as viewed with reference to FIG. 10 of the drawings, of the reversing valve spool 98. This initiates the down stroke of the piston 72 for completion of the cycle.

Figure 7:
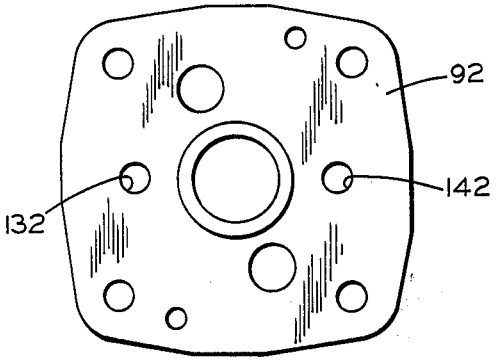
FIG. 7 is an end view of the body portion of the reversing assembly of a fluid operated breaker constructed in accordance with the present invention, illustrating the channels formed therein for fluidically connecting the reversing assembly with the other major component parts of the fluid operated breaker.
Figure 8:
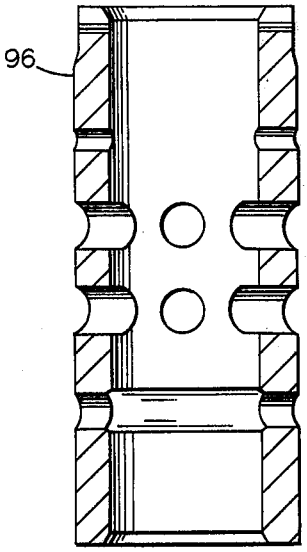
FIG. 8 is a cross-sectional view on an enlarged scale of the reversing valve sleeve of the reversing assembly of a fluid operated breaker constructed in accordance with the present invention.
Figure 9:
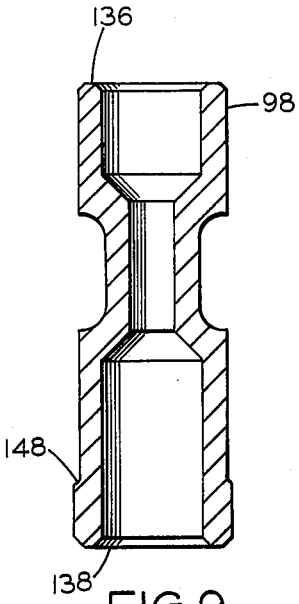
FIG. 9 is a cross-sectional view on an enlarged scale of the reversing valve spool of the reversing assembly of a fluid operated breaker constructed in accordance with the present invention.

Two relatively small diameter, i.e., 3/16 inch holes 154 are formed in reversing valve sleeve 96, causing a restriction of exhaust fluid during upstroke of the piston 72 and causing high pressure oil to enter the bore 106 of the accumulator section 32 through channel 162. Referring to FIG. 7 of the drawings, it can be seen therefrom that the body portion 92 of the reversing valve assembly 30 is provided with a plurality of channels. More particularly, the body portion includes the channel 132, the channel 142, the channel 140 which goes to exhaust, the channel 156 which goes to pressure, and the center channel 152. Pressure oil acting directly in channel 142 causes a downward movement, as viewed with reference to FIG. 10 of the drawings, of the reversing valve spool 98. For upward movement of the reversing valve spool 98, as viewed with reference to FIG. 11 of the drawings, the pressure oil must communicate through the center of the valve spool 98 and act on the effective force area of end 138 of the valve spool 98. One important characteristic feature of the breaker 10 resides in the fact that the step up force area formed by the flanged portion 148 of the valve spool 98 causes an area of pressure imbalance for displacing the valve spool 98. More particularly, in contrast to what is normally the case, when pilot pressure is acting on the flanged portion 148 of the reversing valve spool 98, the pilot pressure tends to pull the valve spool 98 downwardly as viewed with reference to FIGS. 10 and 11 of the drawings instead of pushing it upwardly. Similarly, pilot pressure acting on the top, i.e., end 136 of the valve spool 98 also has the effect of causing valve spool 98 to move toward that source of pressure, i.e., upwardly as viewed with reference to FIGS. 10 and 11 of the drawings, instead of away from it. It can thus be understood that the flanged portion 148, i.e., the step up force area formed on the reversing valve spool 98 is operable to cause the valve spool 98 to be pulled to position rather than being pushed thereto, the latter being the mode of operation in prior art breaker designs. The step design of the reversing valve spool 98 allows for simplifed construction not requiring any pins, or any other associated parts to provide switching force areas, as found in prior art breaker structures. Moreover, the breaker 10 constructed in accordance with the present invention is characterized by the fact that it allows for small switch areas and large spool size for free flow of fluid and at the same time can be made reasonably light due to its hollow construction. Another desirable characteristic feature of the breaker 10 resides in the provision of a vent line which interconnects the accumulator section 32 and the reversing valve assembly 30 and which functions to relieve any leakage, past the various gasket seals, to the low pressure fluid circuit keeping the hydraulic fluid, i.e., oil from contaminating the compressed gas and vice versa.

Although only one embodiment of a fluid operated breaker constructed in accordance with the present invention has been shown in the drawings and described hereinabove, it is nevertheless to be understood that other modifications in the construction thereof may still be made thereto by those skilled in the art without departing from the essence of the invention. In this connection, some of the modifications which can be made in the subject fluid operated breaker have been alluded to hereinabove, while others will become readily apparent to those skilled in the art when exposed to the present description and illustrated of the construction of the fluid operated breaker 10. For example, although the breaker body 12 has been shown as having a substantially rectangular external configuration, it is to be understood that the breaker body could embody other external configurations without departing from the essence of the invention. In addition, in accord with the illustrated embodiment, the accumulator section 32 and the reversing valve assembly section 30 are illustrated fastened to the body section 28 by virtue of four fasteners 164. However, it is to be understood that other means could equally well be utilized for this purpose without departing from the essence of the invention. Also, other means could be employed for purposes of operatively connecting the trigger 58 to the On-Off valve spool 48 without departing from the essence of the invention.

The fluid operated breaker 10 constructed in accordance with the present invention has the following general physical and operating characteristics. It weighs approximately 74 pounds, and has a length of 30 inches, a diameter of 5 inches, and a handle width of 16 inches. The pressure range of the hydraulic fluid employed in the breaker 10 is from 1200 to 2000 psi. The breaker 10 is capable of running off any hydraulic source which has a flow rate of between 8 and 12 gallons per minute with the optimum rate of flow being 10 gallons per minute. At the optimum rate of flow the breaker 10 operates at a speed of 1500 impacts per minute.

Although for purposes of description, the invention has been described as being embodied in a reciprocating impact-type tool. It is to be understood that the invention is not limited to such applications. Rather, the reversing valve assembly of the present invention is also capable of being utillized in other forms of fluid operated tools for purposes of causing the linear movement of a tool member such as, for example, a hydraulically operated saw, a hydraulically operated pruner, a hydraulically operated crimping device, etc. The latter types of tool members are merely set forth for purposes of exemplifying some of the other various types of tool members to which linear movement may be imparted by a fluid operated tool constructed in accordance with the present invention, and are not intended to be all inclusive. Similarly, the accumulator system which has been described hereinabove and the construction of which is illustrated in the drawings is not limited in its applicability solely to reciprocating impact-type tools. To the contrary, such an accumulator system is capable of being employed in other forms of hydraulically operated devices wherein it is desired to provide a means which is capable of storing energy for subsequent release under preselected conditions, at a predetermined time interval, etc. Moreover, it is to be noted that for some application it may be found desirable to omit the accumulator system for a reciprocating impact-type tool.

Thus, it can be seen that the present invention provides a novel and improved fluid operated breaker which possesses a high power-to-ratio thereby providing increased efficiency and also lessening operator fatigue. Moreover, the fluid operated breaker of the present invention does not require any bulky compressor for its operation thereby permitting lower capital expenditures. Furthermore, in accord with the present invention a fluid operated breaker is provided which produces a low sound level thereby reducing noise pollution. The fluid operated breaker of the present invention by virtue of the fact that it is powered by oil is self-lubricating thereby obviating the need to provide some form of dryer therewith to prevent the formation therein of water which causes corrosion in the tool, and thereby as a result substantially reduces maintenance costs. In addition, a fluid operated breaker has been provided which is capable of being employed to drive tools of the type presently known in the prior art. Also, in accord with the present invention a fluid operated breaker has been provided wherein the reversing valve spool is pulled ot its positions rather than being pushed thereto. Finally, a fluid operated breaker has been provided which has a simplied construction that allows for small switch areas and large spool size for free flow of fluid and at the same time can be made reasonably tight by virtue of its hollow construction whereby to enable economies of manufacture and assembly to be achieved.

Having thus described out invention, we claim:

1. In a fluid operated tool operable for reciprocating linear movement of a tool member, the combination comprising:

a body member having a first bore extending longitudinally thereof and a second bore spaced therefrom, inlet means and outlet means formed therein, and means for detachably mounting a tool member at one end of said body member;

b. trigger means mounted on said body member for movement between an actuating position and a rest position;

c. a piston supported in said first bore of said body member for reciprocating movement in said bore between a first position adjacent said one end of said body member wherein said piston may drive the associated tool member in the direction of said one end of said body member and a second position spaced from said one end of said body member;

d. reversing valve means supported in said body member including an integral reversing valve spool supported in said second bore for movement between a first position and a second position, solely by hydraulic fluid action said spool having end faces, a passage extending therethrough between said end faces and a circumferential collar adjacent one end face providing a cross sectional area for said one face larger than that of the other end face, a radially extending circumferential collar shoulder intermediate said end facing oppositely of said one end face and providing a step up force area, said second bore being cooperatively dimensioned and configured for sliding movement of said spool therein, said second bore having an enlarged portion adjacent one end to snugly seat the portion providing said collar and collar shoulder during sliding movement of said valve spool and another portion of lesser cross sectional area to snugly seat the other end portion of said valve spool during movement thereof, said one end face providing a first force effective area and said other end face providing a second force effective area; and e. hydraulic circuit means including conduits in said body member between said first and second bores and connecting said inlet and outlet means with said bores, said hydraulic circuit means being operable to provide alternate hydraulic circuits within said body member, said hydraulic circuit means being operable when said trigger means is in said actuating position to provide a first hydraulic circuit from said inlet means through said body member to said reversing valve spool to establish therethrough a flow path to cause hydraulic fluid to be applied to said first force effective area to produce a force thereon and hydraulic fluid to flow through said passage in said reversing valve spool and to be applied to said second force effective area to produce a force thereon wherein the resultant force produced by the hydraulic fluid acting on said first and second force effective areas causes said reversing valve spool to move to said second position thereof, said hydraulic circuit means being operable when said reversing valve spool reaches said second position thereof to establish a second hydraulic circuit from said inlet means through said body member to said position to provide a flow path therethrough to cause hydraulic fluid to be applied to said piston to produce a force thereon to move said piston to said second position thereof, said hydraulic circuit means being operable when said piston reaches said second position thereof to establish a third hydraulic circuit from said inlet means through said body member to said reversing valve spool to provide a flow path therethrough to cause hydraulic fluid to be applied to said step up force area to produce a force thereon to cause said reversing valve spool to move to said first position thereof, and said hydraulic circuit means being operable when said reversing valve spool reaches said first position thereof to establish a fourth hydraulic circuit from said inlet means through said body member to said piston to provide a flow path therethrough to cause hydraulic fluid to be applied to said piston to move said piston to said first position thereof wherein said piston is driven towards said one end of said body member and may thereby drive an associated tool member.

2. The fluid operated tool as set forth in claim 1 wherein said trigger means includes an On-Off valve spool supported in said body member for movement between an On condition and an Off condition, and a trigger mounted externally on said body member and operatively connected to said On-Off valve spool whereby when said trigger is actuated said On-Off valve spool is in said On condition and when said trigger is unactuated said On-Off valve spool is in said Off condition.

3. The fluid operated tool as set forth in claim 1 wherein said body member is provided with a third bore and wherein there is provided in said body member accumulator means including an accumulator piston slidably supported in said third bore of said body member for movement between a first position whereby to cause energy to be stored in said accumulator means and a second position whereby to cause the energy stored in said accumulator means to be released wherein the released energy augments the hydraulic fluid force which drives said piston to said first position thereof thereby increasing the force with which said piston drives the associated tool member.

4. A fluid operated tool, operable for repetitively striking an associated tool bit to drive the tool bit against a surface, comprising:

a. a body member including a body section, a reversing valve assembly section, an accumulator section, and means for detachably mounting a tool bit at one end of said body section, said body section, reversing valve assembly section and accumulator section having respectively first, second and third bores therein, said first bore extending longitudinally of said body section, said body section further having inlet and outlet means formed therein and a fourth bore spaced from said first bore and communicating with said inlet and outlet means;

b. On-Off valve means supported in said fourth bore in said body section having an On condition and an Off condition;

c. a piston supported in said first bore of said body section for reciprocation in said first bore between a first position adjacent said one end of said body section wherein said piston may drive the associated tool bit and a second position wherein said piston is spaced from said one end of said body section and thereby from the associated tool bit;

d. reversing valve means supported in said reversing valve assembly section including an integrally formed reversing valve spool supported in said second bore for movement between a first position and a second position, solely by hydraulic fluid action said spool having end faces, a passage extending therethrough between said end faces and a circumferential collar adjacent one end face providing a cross sectional area for said one end face larger than that of the other end face, a radially extending circumferential collar shoulder intermediate said end faces facing oppositely of said one end face and providing a step up force area, said second bore being cooperatively dimensioned and configured for sliding movement of said spool therein, said second bore having an enlarged portion adjacent one end to snugly seat the portion providing said collar and collar shoulder during sliding movement of said valve spool and another portion of lesser cross sectional area to snugly seat the other end portion of said valve spool during movement thereof, said one end face providing a first force effective area and said other end face providing a second force effective area;

e. an accumulator piston supported in said third bore in said accumulator section for movement in said bore between a first position to cause energy to be stored in a fluid in said third bore of said accumulator section and a second position to cause energy to be released by the fluid in said accumulator section; and f. hydraulic circuit means including conduits in said reversing valve assembly, accumulator and body sections interconnecting the several bores and said inlet and outlet means, said hydraulic circuit means being operable to provide alternate hydraulic circuits interconnecting the bores containing said On-Off valve means, said piston, said reversing valve spool and said accumulator piston, said hydraulic circuit means with said On-Off valve means in said On condition being operable to establish a first hydraulic circuit from said inlet means through said body section and reversing valve assembly section operative to apply a hydraulic fluid force to said reversing valve spool to establish therethrough a flow path to cause hydraulic fluid to be applied to said first force effective area to produce a force thereon and hydraulic fluid to flow through said passage in said reversing valve spool and to be applied to said second force effective area to produce a force thereon wherein the resultant force produced by the hydraulic fluid acting on said first and second force effective areas causes said reversing valve spool to move to said second position thereof, said hydraulic circuit means being operable when said reversing valve spool reaches said second position thereof to establish a second hydraulic circuit from said inlet means through said body section to said first bore to apply a hydraulic fluid force to said piston causing said piston to move to said second position thereof and said accumulator piston to occupy said first position thereof, said hydraulic circuit means being operable when said piston reaches said second position thereof to establish a third hydraulic circuit from said inlet means through said body section and reversing valve assembly section to said second bore to apply a hydraulic fluid force to said step up force area of said reversing valve spool causing said reversing valve spool to move to said first position thereof, and said hydraulic circuit means being operable when said reversing valve spool reaches said first position thereof to establish a fourth hydraulic circuit from said inlet means through said body section to said first bore and from said third bore in said accumulator section to said first bore to cause said accumulator piston to move to said second position thereof thereby releasing the energy stored in the fluid in said accumulator bore and also operable to apply to said piston a hydraulic fluid force which is augmented by the energy released from said accumulator section causing said piston to be driven to said first position thereof wherein said piston may strike the associated tool bit.

5. The fluid operated tool as set forth in claim 4 further including trigger means mountee externally on the tool and operatively connected to said On-Off valve means for actuating said On-Off valve means to said On condition thereof.

6. The fluid operated tool as set forth in claim 4 wherein said fourth bore is longitudinally extending in said body section and spaced from said first bore, the conduits communicating with said fourth bore and said On-Off valve spool being operable when said On-Off valve means is in said Off condition to establish a direct flow path from said inlet means to said outlet means for hydraulic fluid fed to the tool through said inlet means, and operable when said On-Off means is in said On condition to provide a flow path from said inlet means to said hydraulic circuit means for hydraulic fluid fed to the tool through said inlet means and a flow path from said hydraulic circuit means to said outlet means to exhaust hydraulic fluid from the tool.

7. The fluid operated tool as set forth in claim 5 wherein said accumulator section includes a hollow body portion having a pair of open ends with said third bore extending therebetween, an accumulator head mounted on said body portion of said accumulator section to close one of said open ends thereof, charging valve means supported in said accumulator head and communicating with the portion of said fourth bore between said accumulator piston and said accumulator head whereby said charging valve means is operable to supply a charge of compressed gas to said bore portion which comprises the fluid for energy storage, and vent means formed in said body portion of said accumulator section operable to prevent the hydraulic fluid from contaminating the compressed gas.

8. In a fluid operated tool operable for reciprocating linear movement of a tool member, the combination comprising:

a. body member having a first bore extending longitudinally thereof, second and third bores spaced therefrom, inlet means and outlet means formed therein, and means for detachably mounting a tool member at one end of said body member;

b. trigger means mounted on said body member including valve means in said third bore for movement between an actuating position and a rest position;

c. a piston supported in said first bore of said body member for reciprocal movement between a first position adjacent said one end of said body member wherein said piston may drive the associated tool member in the direction of said one end of said body member and a second position spaced from said one end of said body member;

d. accumulator means including a hollow body portion having a paif of open ends and a fourth bore extending therebetween, an accumulator piston supported in said fourth bore of said body portion for movement between a first piston to cause energy to be stored in a fluid in said fourth bore of said accumulator means, and a second position to cause energy to be released by the fluid in said accumulator means, an accumulator head mounted on said body portion to close one of said open ends thereof, charging valve means supported in said accumulator head and communicating with the portion of said bore between said piston and said accumulator head whereby said charging valve means is operable to supply a charge of compressed gas to said bore portion, and vent means formed said body portion operable to prevent the hydraulic fluid from contaminating the compressed gas;

e. reversing valve means supported in said body member including an integrally formed reversing valve spool supported in said second bore for movement between a first position and a second position, solely by hydraulic fluid action said spool having end faces, a passage extending therethrough between said end faces and a circumferential collar adjacent one end face providing a cross section area for said one end face larger than that of the other end face, a radially extending circumferential collar shoulder intermediate said end faces facing oppositely of said one end face and providing a step up force area, said second bore being cooperatively dimensioned and configured for sliding movement of said spool therein, said second bore having an enlarged portion adjacent one end to snugly seat the portion providing said collar and collar shoulder during sliding movement of said valve spool and another portion of lesser cross sectional area to snugly seat the other end portion of said valve spool during movement thereof, said one end face providing a first force effective area and said other end face providing a second force effective area; and f. hydraulic circuit means including conduits in said body member and accumulator means interconnecting the several bores and said inlet and outlet means, said hydraulic means being operable to provide alternate hydraulic circuits in said body member beween the bores containing said trigger means, said piston, said reversing valve spool and said accumulator means, said hydraulic circuit means with said trigger means in said actuating position being operable to establish a first hydraulic circuit in the tool from said inlet means through said body member to cause hydraulic fluid to be applied to said first force effective area to produce a force thereon and hydraulic fluid to flow through said passage in said reversing valve spool and to be applied to said second force effective area to produce a force thereon wherein the resultant force produced by the hydraulic fluid acting on said first and second force effective areas causes said valve spool to move to said second position thereof, said hydraulic circuit means being operable when said reversing valve spool reaches said second position thereof to establish a second hydraulic circuit from said inlet means through said body member to said first bore to spply hydraulic fluid force to said piston causing said piston to move to said second position thereof and said accumulator piston to occupy said fist position thereof, said hydraulic circuit means being operable when said piston reaches said second position thereof to establish a third hydraulic circuit from said inlet means through said body member to said second bore to apply a hydraulic fluid force to said step up force area of said reversing valve spool causing said reversing valve spool to move to said first position thereof, and said hydraulic circuit means being operable when said reversing valve spool reaches said first position thereof to establish a fourth hydraulic circuit from said inlet means to said first bore and from said bore in said accumulator section to said first bore to cause said accumulator piston to move to said second position thereof thereby releasing the energy stored in the fluid in said accumulator means and also operable to apply to said piston a hydraulic fluid force which is augmented by the energy released from said accumulator means causing said piston to be driven to said first position thereof wherein said piston may drive the associated tool member towards said one end of said body member.

9. The fluid operated tool as set forth in claim 1 wherein there is provided a cylindrical tubular sleeve in said body member defining said second bore, said sleeve having apertures in the wall thereof cooperating with said conduit portions in said body member to provide said hydraulic circuit means.

10. The fluid operated tool as set forth in claim 4 wherein there is provided a cylindrical tubular sleeve in said reversing valve assembly section defining said second bore, said sleeve having apertures in the wall thereof cooperating with said conduit portions in said reversing valve assembly section.

* * * * *

UNITED STATES PATENT AND TRADEMARK OFFICE

CERTIFICATE OF CORRECTION

PATENT NO. : 3,971,448

DATED : July 27, 1976

INVENTOR(S) : Stephen Earl Crover et al

It is certified that error appears in the above-identified patent and that said Letters Patent are hereby corrected as shown below:

Column 13, line 53, after "end" insert -- faces --;

Column 14, line 21, "position" should be -- piston --;

Column 16, line 40, "mountee" should be -- mounted --;

Column 17, line 25, "paif" should be -- pair --;

Column 17, line 28, "piston" should be -- position --;

Column 17, line 40, after "formed" insert -- in --;

Column 17, line 50, "section" should be -- sectional --;

Column 18, line 27, "spply" should be -- supply --;

Column 18, line 30, "fist" should be -- first --.

Signed and Sealed this

Thirtieth Day of November 1976

[SEAL]

*Attest:*

RUTH C. MASON
*Attesting Officer*

C. MARSHALL DANN
*Commissioner of Patents and Trademarks*